US008949118B2

(12) United States Patent
Avargel et al.

(10) Patent No.: US 8,949,118 B2
(45) Date of Patent: Feb. 3, 2015

(54) SYSTEM AND METHOD FOR ROBUST ESTIMATION AND TRACKING THE FUNDAMENTAL FREQUENCY OF PSEUDO PERIODIC SIGNALS IN THE PRESENCE OF NOISE

(75) Inventors: Yekutiel Avargel, Ashkelon (IL); Tal Bakish, Modiin (IL)

(73) Assignee: Vocalzoom Systems Ltd., SDE-Boker (IE)

( * ) Notice: Subject to any disclaimer, the term of this patent is extended or adjusted under 35 U.S.C. 154(b) by 292 days.

(21) Appl. No.: 13/423,526

(22) Filed: Mar. 19, 2012

(65) Prior Publication Data

US 2013/0246062 A1 Sep. 19, 2013

(51) Int. Cl.
*G10L 21/00* (2013.01)
*G10L 25/90* (2013.01)

(52) U.S. Cl.
USPC ..... 704/207; 704/206; 704/205

(58) Field of Classification Search
CPC ..... G10L 15/04–15/05
USPC ..... 704/207–209, 216–218, 226–228
See application file for complete search history.

(56) References Cited

U.S. PATENT DOCUMENTS

| | | | | |
|---|---|---|---|---|
| 6,587,816 | B1 * | 7/2003 | Chazan et al. | 704/207 |
| 7,124,075 | B2 * | 10/2006 | Terez | 704/203 |
| 7,266,493 | B2 * | 9/2007 | Su et al. | 704/207 |
| 7,353,167 | B2 * | 4/2008 | Puterbaugh et al. | 704/207 |
| 7,593,847 | B2 * | 9/2009 | Oh | 704/207 |
| 2004/0225493 | A1 * | 11/2004 | Jung et al. | 704/207 |
| 2010/0070270 | A1 * | 3/2010 | Gao | 704/207 |
| 2010/0280826 | A1 * | 11/2010 | Bakish | 704/226 |
| 2011/0191101 | A1 * | 8/2011 | Uhle et al. | 704/205 |

OTHER PUBLICATIONS

Israel Cohen et al; "Speech enhancement for non-stationarynoise environments", Signal Processing, vol. 81, pp. 2403-2418, (2001).

Israel Cohen; "Noise Spectrum Estimation in Adverse Environments: Improved Minima Controlled Recursive Averaging", IEEE Transactions on Speech and Audio Processing, vol. 11, No. 5, pp. 466-475, (2003).

* cited by examiner

*Primary Examiner* — Jesse Pullias
(74) *Attorney, Agent, or Firm* — Browdy and Neimark, PLLC

(57) ABSTRACT

Method and system for tracking fundamental frequencies of pseudo-periodic signals in the presence of noise that include receiving a time-frequency representation of signals measured in a predefined environment; estimating and tracking a fundamental frequency of a respective pseudo-periodic signal at each time frame of the time-frequency representation by tracking detections of harmonious frequencies in the time-frequency representation over time; and outputting each respective estimated fundamental frequency associated with the pseudo-periodic signal of each respective time frame.

19 Claims, 7 Drawing Sheets

60 i = 3

| | $f_1$ | $f_2$ | $f_3$ |
|---|---|---|---|
| SNR avg. | 10 | 20 | 17 |
| N-detect | 1 | 1 | 3 |
| f value | 100 | 120 | 129.9 |
| $f_0$ frames | [Ø] | [1] | [2,3] |
| Update frame | 1 | 1 | 3 |

Fig. 3

SYSTEM AND METHOD FOR ROBUST ESTIMATION AND TRACKING THE FUNDAMENTAL FREQUENCY OF PSEUDO PERIODIC SIGNALS IN THE PRESENCE OF NOISE

FIELD OF THE INVENTION

The present invention generally relates to systems and methods for signal processing and analysis and more particularly to systems and methods for detecting fundamental frequencies of pseudo-periodic signals in noisy environments.

BACKGROUND OF THE INVENTION

Voice recognition systems require optimal noise estimation and reduction for distinguishing speech related signal characteristics from noise related signals. Noise can result from environmental sources (such as other speakers, background noises etc.) and/or from the detection system itself (e.g. microphone quality, processing methods and equipment, etc.). Speech detection systems use various methods for distinguishing speech related signals from noise based on audio recording/receiving of speech related acoustic signals (e.g. using an acoustic microphone system for detection of sound).

Two such known methods are Log-Spectral Amplitude (LSA) or optimally modified LSA (OMLSA). LSA estimators minimize the mean square error of the log spectra, based on Gaussian statistical models (see "*Speech Enhancement for Non-Stationary Noise Environments*", Israel Cohen and Baruch Berdugo, *Signal Processing*, vol. 81, pp. 2403-2418, November 2001, referred to hereinafter as Cohen 1, which is incorporated by reference in its entirety to this application). OMLSA is based on the time-frequency distribution of signal-to-noise ratio (SNR) of the detected audio signal.

The minimal Controlled Recursive Averaging (MCRA) noise estimation approach is a method for noise estimation used for speech enhancement or detection, which combines minimum tracking with recursive averaging, such as described in Cohen 1, page 2405. This algorithm uses probability functions for estimating the speech and for controlling adaptation of the noise spectrum by determining the ratio between the local energy of the noisy signal and its minimum within a specified time window. An improved MCRA (IMCRA) is also described in another paper by Israel Cohen (see "*Noise Spectrum Estimation in Adverse Environments: Improved Minima Controlled Recursive Averaging*", Israel Cohen,: *IEEE Trans. Speech Audio Processing*, vol. 11, no. 5, pp. 466-475, September 2003 referred to hereinafter as Cohen 2, which is incorporated by reference in its entirety to this application). "The IMCRA involves averaging past spectral power values, using a time-varying frequency-dependent smoothing parameter that is adjusted by the signal presence probability." (see Cohen 2, abstract).

SUMMARY OF THE INVENTION

The present invention, according to some embodiments thereof, provides method and system for tracking fundamental frequencies of pseudo-periodic signals in the presence of noise.

According to some embodiments of the present invention, there is provided a method of tracking fundamental frequencies of pseudo-periodic signals in the presence of noise. The method includes receiving a time-frequency representation of signals measured in a predefined environment; estimating and tracking a fundamental frequency of a respective pseudo-periodic signal at each time frame of the time-frequency representation by tracking detections of harmonious frequencies in the time-frequency representation over time; and outputting each respective estimated fundamental frequency associated with the pseudo-periodic signal of each respective time frame.

According to some aspects of the present invention, the tracking of detections of fundamental frequencies is a recursive process done in real time or in near real time on a frame-by-frame basis wherein a respective fundamental frequency is tracked and identified in each time frame of the time-frequency representation.

Optionally, the estimation and tracking of the fundamental frequency of each respective time frame includes: identifying harmonious frequencies in each time frame of the time-frequency representation; checking correlations between each identified harmonious frequency and harmonious frequencies identified in preceding time frames; allocating a new tracker to each respective identified uncorrelated harmonious frequency; updating information relating to each tracker including number of identified correlations associated with each tracker; and determining the fundamental frequency of the respective time frame by selecting one of these trackers, according to predefined rules associated with accumulated information of the trackers, including the number of correlations associated with each tracker.

Optionally, updating of the information comprises updating predefined fields of the trackers, said fields include at least one of: signal power field, indicative of the average signal intensity of each tracker; detections field, indicative of the number of times the associated tracker has been detected, which is indicative of the correlations number of the respective tracker; frequency value field, indicative of the average value of the frequency associated with each respective tracker; frames field, each is an array field associated with each respective said tracker that has been identified as a fundamental frequency, wherein each component in the array is indicative of the time frame number in which the fundamental frequency tracker has been tracked; and/or last update field, indicative of the last time frame number of the respective tracker, in which the respective tracker has been tracked.

According to some embodiments, each detected fundamental frequency of the respective time frame is determined by selecting a tracker that has an optimal combination of signal power, using the signal power field, and number of detections, using the detections field, in respect to a duration level of the respective tracker calculated according to said frames field of each respective tracker, where the duration level is indicative of the number of successive detections of said respective tracker.

The method may optionally further include identifying a durable fundamental frequency (DFF) out of the trackers, using the duration level, and operating a reduced estimation and tracking procedure upon identification of the DFF, for tracking only the identified DFF.

The identification of a respective DFF may optionally be carried out by checking whether the number of detections of each tracker, using its respective detections field, exceeds a predefined threshold number, indicating the continuous fundamental frequency tracker and rejecting all other trackers, where the reduced tracking procedure comprises identifying new harmonious frequencies in the respective current time-frame and checking their correlation with the continuous fundamental frequency, wherein correlated detections are used for updating the fields associated with the respective DFF. The reduced tracking procedure may be terminated upon identifying discontinuity of the continuous fundamental frequency, using the associated fields, where the termination allows reverting to previous procedure.

According to some embodiments, the method further includes: receiving a detected signal input in real time or near real time; and operating a signal transformation, such as a short-time Fourier transform (STFT) transformation, over the received signal input, in real time, where the transformation enables transforming the respective signal representation into the respective time-frequency representation.

Noise Spectrum Evaluation and/or peak detection may further be implemented, in real time or in near real time over the time-frequency representation. The Noise Spectrum Evaluation may include evaluation techniques based on minima controlled recursive averaging (MCRA) or improved MCRA.

According to some embodiments, the trackers may be updated before determining a respective fundamental frequency of the respective time frame, wherein the updating of the trackers includes at least one of: checking for trackers that are harmonious to one another, according to predefined rules, using the frequency value field, and merging such identified harmonious trackers; checking for trackers that have secondary correlations with one another, according to predefined rules, using the frequency value field, and merging such identified correlated trackers; and/or identifying outdated trackers, using last update field, and discarding all trackers that are identified as outdated.

Optionally, the pseudo-periodic signal is an acoustic signal indicative of human speech measured in the noisy environment, wherein the acoustic signal is acquired by using at least one signal measurement system. The fundamental frequency identification and associated information thereof with each time frame may be used for enhancing speech detection of the acoustic signal, by indicating the pitch of the detected speech in each respective time frame, wherein the respective pitch is proportional to the fundamental frequency of the respective time frame.

The signal measurement system may include at least one optical or acoustic device enabling to optically or acoustically measure and represent said acoustic signals in said noisy environment. For example, the signal measurement system may include at least one optical microphone, which is based on optical vibrometry detection of sound.

According to some embodiments of the present invention there is provided a system for tracking fundamental frequencies of pseudo-periodic signals in the presence of noise. The system includes: a signal measurement system for measuring pseudo-periodic signals in a predefined environment; at least one processing unit, which receives measured pseudo-periodic signals in real time or near real time from the signal measurement system, processes the signal for obtaining a time-frequency representation thereof in real time or near real time and recursively estimates and tracks a respective fundamental frequency of each respective pseudo-periodic signal at each time frame of said time-frequency representation by tracking detections of harmonious frequencies in said time-frequency representation over time. The processing unit can output the respective estimated fundamental frequency associated with the pseudo-periodic signal of the respective time frame.

Optionally, the signal measurement system comprises an optical measurement system for optically detecting the pseudo-periodic signals in the environment. The optical measurement system may include an optical microphone enabling vibrometry-based detection of acoustic signals including speech related signals, where the optical microphone is located in proximity to vibrating surfaces of a respective speaker.

According to some embodiments of the present invention, the system is operatively associated with at least one audio system enabling to additionally acoustically measure the acoustic signals in the environment, wherein fundamental frequencies estimated by using respective optically measured signals are used to improve corresponding detection of acoustic signals carried and outputted by the acoustic system, for voice activity detection (VAD) or any other purpose.

According to some embodiments, the estimation and tracking of the fundamental frequency of each respective time frame is carried out by: identifying harmonious frequencies in each time frame of the time-frequency representation; checking correlations between each identified harmonious frequency and harmonious frequencies identified in preceding time frames; allocating a new tracker to each respective identified uncorrelated harmonious frequency; updating information relating to each tracker including number of identified correlations associated with each tracker; and determining said fundamental frequency of the respective time frame by selecting a tracker according to accumulated information including the number of correlations associated therewith.

The system may include designated one or more modules such as a fundamental frequency detection module for detecting and tracking the fundamental frequencies and outputting thereof, where the fundamental frequency detection module is a software application operated by the processing unit.

BRIEF DESCRIPTION OF THE DRAWINGS

FIG. 3 schematically illustrates a table representing registration of information relating to tracked harmonious frequencies of three sequential time frames, for identification of a current fundamental frequency, according to some embodiments of the present invention.

DETAILED DESCRIPTION OF THE INVENTION

Figure 1:
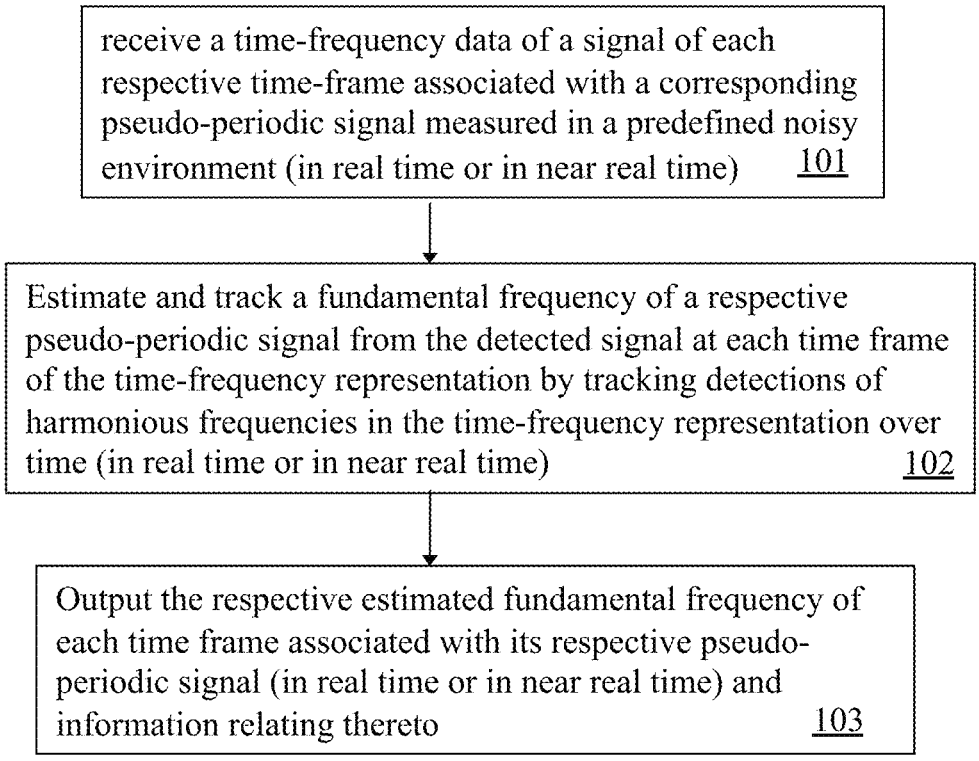
FIG. 1 is a flowchart, schematically illustrating a process of estimation and tracking of fundamental frequencies ($f_0$) of pseudo-periodic signals in a non-stationary noisy environment, according to some embodiments of the present invention.

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides methods and systems for robust estimation and tracking of fundamental frequencies of pseudo-periodic signals in non-stationary noisy environments. The methods and systems enable receiving signals measured in a noisy environment and/or time-frequency representation of those measured signals and processing these signals to identify at each given time frame the respective fundamental frequency of the pseudo-periodic signal within the measured (noisy) corresponding signal, thereby reduce and "clean out" noises that are unrelated to the pseudo-periodic signal and identifying the fundamental frequency thereof. The pseudo-periodic signal (e.g. a speech related acoustic signal) is measured by one or more signal measurement systems such as one or more acoustic and/or optical microphones along with noises of various types and behavior depending on the type of the pseudo periodic signal, the measurement system and the environmental noises and effects. The noise can originate from external environmental sources such as other sound sources and/or may be created by the detection devices.

According to some embodiments of the present invention, the measured signals are analyzed and/or processed by the estimation and tracking system for recursively estimating and tracking a fundamental frequency of the respective pseudo-periodic signal at each time frame. Each respective fundamental signal is identified by tracking detections of harmonious frequencies in a time-frequency representation of the measured signal, over time, outputting an estimated fundamental frequency associated with the pseudo-periodic signal of the respective time frame. Each of the tracked fundamental frequency and/or any other associated information may be automatically stored in one or more memory units (e.g. computer data storage) for allowing later utilization of this information for example, for speech enhancement in a case of acquiring of acoustic signal associated with speech, or for any other usage or purpose.

This process is recursive and carried out on a frame-by-frame basis, allowing accumulated information regarding the tracked fundamental frequency and other detected harmonious frequencies of preceding time-frames, to be used for deciding the fundamental frequency of each current given time frame allowing refining and correcting the frequency value of the fundamental frequency over time.

These methods and systems are particularly yet not exclusively efficient for speech detection/enhancement and/or voice activity detection (VAD) that can be used for various purposes such as for speech recognition, speech parts recognition (e.g. identification of beginning and ending of each word or phoneme of speech), speaker identification (e.g. by identifying typical speech pitch frequency of each speaker) as well as for noise reduction.

The term "pseudo-periodic signal" refers to any signal that shows cyclic patterns that can be represented by pseudo-periodic functions, such as, for example, speech and/or music related acoustic signals.

The term "fundamental frequency" is defined as the lowest frequency of a periodic and/or pseudo-periodic waveform.

The term "harmonious frequencies", "harmonies" or "harmonics" each refers to all frequencies that are multiplications of the same fundamental frequency.

According to some embodiments of the present invention, the estimation of the fundamental frequency of each time frame includes identifying harmonious frequencies in each time frame of a time-frequency representation of the measured signal; checking correlations between each identified harmonious frequency and harmonious frequencies identified in preceding time frames (using past detected and tracked frequencies); allocating a new tracker to each respective identified uncorrelated harmonious frequency; updating information relating to each tracker including number of identified correlations associated with each tracker; and determining the fundamental frequency of the respective time frame, according to predefined conditions and rules such as, for instance by selecting a tracker of a frequency that exceeds a predefined threshold intensity value that has the maximal substantially number of consecutive correlations up to the respective time frame.

In this way, a previously detected fundamental frequency and other candidate such fundamental frequencies are tracked over time in real time or in near real time. This tracking can be used to various purposes, depending, inter alia, on the type of pseudo-periodic signal (speech related acoustic signal, optical signal, digital signal etc.) and system requirements.

For example, for processing of acoustic signals acquired in a noisy environment for detection/enhancement of human speech of a single speaker, the methods and systems described in this document can assist in noise reduction as well as for speech recognition, VAD and/or speaker identification. In this example, the fundamental frequency of speech is defined as a pitch. The pitch detection can enhance speaker identification by identification of current typical pitch of the relevant speaker as well as speech recognition by identification of speech related pitches (e.g. speech related typical frequencies) and also recognition of speech segments (e.g. beginnings and endings of words, syllables, phonemes and the like) since tracking speech related frequencies can indicate where there are no such frequencies detected over time signifying no-speech and therefore the end of a speech segment.

According to some embodiments of the present invention, there is provided a software application, which carries out most or all of the steps of the method for detection and tracking of the fundamental frequencies. This application can receive signals measured in the non-stationary noisy environment from a signal measurement system, create a time-frequency representation of those signals, e.g. by using one or more mathematical transformation operators (such as one or more Fourier Transform operators) and use this time-frequency representation for detecting and tracking the fundamental frequency of the pseudo-periodic signal associated with the measured signal at each time-frame. The application is designed, in some embodiments of the present invention, to work frame-by-frame, where for each time frame the fundamental frequency is detected while keeping recordation of information relating to past and present tracked candidate and/or identified fundamental frequencies in a recursive manner, allowing continuous tracking of those identified frequencies by using accumulated information relating thereto.

Figure 5:
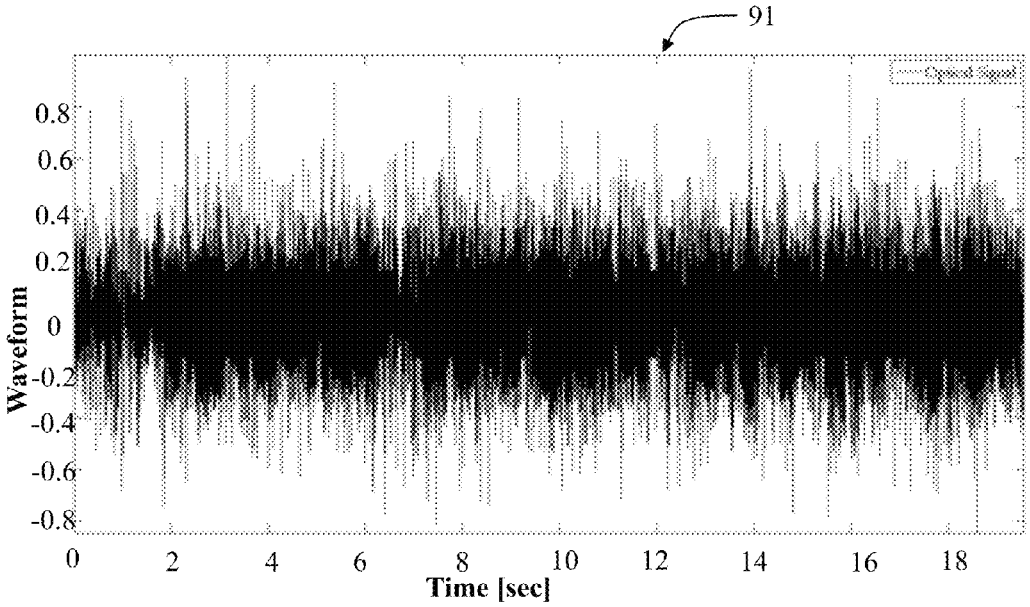
FIG. 5 shows an optical signal representation as outputted from an optical vibrometry system representing acoustic signals including at least one speaker, for using the system and method for speech enhancement, according to some embodiments of the present invention.

According to some embodiments of the present invention, the signal detection system includes an optical and/or an acoustic detector such as an optical and/or acoustic microphone enabling detecting acoustic signals including a speaker's voice signals. According to some embodiments, the optical microphone enables vibrometry-based detection of speech related vibrations of the speaker, where an optical sensor is placed in proximity to vibrating surfaces of the speaker. The optical/acoustic signal (the optical output representation of the detected acoustic signal is illustrated in FIG. 5) is processed in real time or near real time to for detecting and tracking of its corresponding fundamental frequencies, which includes mainly the speaker's voice.

The application is optionally operated by a processor (e.g. a computerized system such as a server computer, a PC, a laptop or any other processor system or device known in the art). The processor may be separated from the signal measurement system and connect thereto for receiving the detected signal in real time through one or more communication links and/or devices (e.g. through a digital wiring or wireless connection). Data is transmitted from the signal measurement system to the processor in real time or near real time, allowing the application or another transformation module (e.g. by using an on-chip transformation Fourier transform operators) to convert this signal data into a corresponding time-frequency representation thereof (correspondently in real time or near real time). The application may output the resulting estimated fundamental frequency and information associated thereto also in real time/near real time. The output data may then be stored and/or further processed depending on system definitions and requirements.

Reference is now made to FIG. 1, which is a flowchart, schematically and generally illustrating a recursive process of detecting and tracking of fundamental frequencies of pseudo-periodic signals detected in a noisy non-stationary environment, according to some embodiments of the present invention.

A time-frequency representation of signals detected 101 in the environment in real time or in near real time is received or created by the application on a frame-by frame basis. The received time-frequency representation is used for recursively estimating and tracking a fundamental frequency of a respective pseudo-periodic signal at each time frame of the time-frequency representation 102 by tracking detections of harmonious frequencies in said time-frequency representation over time. The estimated respective fundamental frequency of each respective time frame is outputted by the application 103, optionally along with information relating thereto such as its estimated value, error/probability rate or grade, and the like. The outputted fundamental frequency and optionally its related information can be stored and/or used for other algorithms/processes.

For example, in case of using this process for noise reduction of acoustic signals, the fundamental frequencies may be used in real time for noise reduction and outputting of a clearer noise-reduced acoustic signal of the speaker, using output audio devices and systems such as audio speakers. Alternatively or additionally, the output fundamental frequencies may be used for VAD purposes, speech and/or speech segments recognition as will be further explained in this document.

Figure 2A:
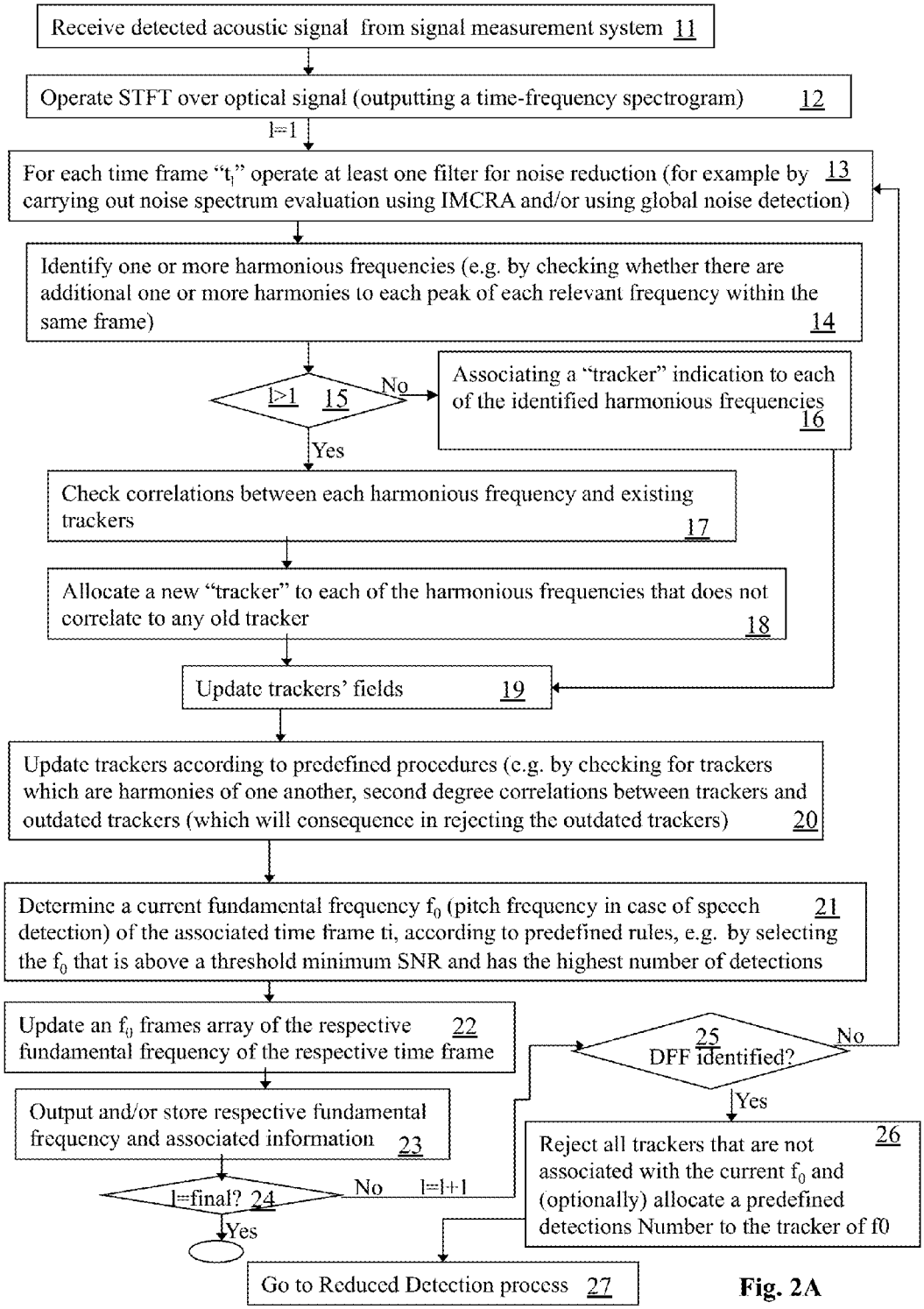
FIG. 2A is a flowchart, schematically illustrating a process of estimation and tracking of fundamental frequencies ($f_0$) of pseudo-periodic signals in a non-stationary noisy environment, according to some embodiments of the present invention.

Reference is now made to FIG. 2A, which is a flowchart, schematically illustrating a recursive process of detecting and tracking of fundamental frequencies of pseudo-periodic signals measured in a noisy non-stationary environment, according to some embodiments of the present invention.

The process includes receiving data indicative of an acoustic signal including a speaker voice related signal (which is the pseudo-periodic signal that is to be identified) of a speaker from a signal measurement system 11. The acoustic signal may be optically acquired, using, for example, an optical vibrometer laser system, which includes an optical laser-based sensor located in the speaker's area. Additionally or alternatively, the acoustic signal is acoustically measured using an audio receiver such as a microphone for measuring sounds from the environment including voice of the speaker and transmitting measured sound into electric/digital signals.

The signal data may include the signal intensity or intensity related value for the respective time frame as acquired in real time by the signal measurement system (which may be for instance an optical microphone such as illustrated in FIG. 5). The received data is then analyzed/processed (e.g. through software and/or hardware means) to establish the corresponding time-frequency representation of the respective time frame, for example, by operating a short time Fourier transform (STFT) operator over the received data 12. This will result, for example, in a data frame indicative of the frequencies' values and their intensity related values associated with the respective time frame.

Optionally, the time-frequency signal representation associated with each time frame "$t_1$", where "1" is the frames index, is filtered for initial noise reduction 13 by using one or more "filter operators", which may be software-based operators.

According to some embodiments, noise spectrum evaluation may be operated for evaluating the noise level of each frequency value of each time frame and thereby excluding frequency measures that are identified as "noise" in the time-frequency representation. For example, if using optically acquired signals, the SNR value of the optical signal may be compared to an evaluated corresponding SNR value thereof e.g. using subtraction of these values, and excluding the frequency measure if the difference between these values does not exceed a predefined threshold. Known noise spectrum evaluation processes and algorithms may be used such as MRCA or IMRCA, for instance, to calculate each evaluated SNR value.

Additionally or alternatively the time-frequency representation for each time frame is further noise-reduced by using noise detection. The noise detection includes detecting frequency peaks of each time frame, thereby excluding non-peak values from the time-frequency representation of each time frame.

According to some embodiments of the present invention, in each time frame, the process enables identifying harmonious frequencies 14 by, for example, searching for frequencies that are multiplications of one another—where one is a multiplication of the other by an integer number: $f_{1i}=I\times f_{1j}$, where "i" and "j" represent a different frequency measure of the same time frame "1" and where I is an integer number. For example, if in a time frame "1" one frequency measure is 151 Hz and another is 300 Hz the algorithm divides the higher one by another and checks how close the ratio is to an integer number (in this example: 300:151=1.99) according to a predefined threshold to decide whether these two frequencies are harmonious to one another. If the time frame is the first time frame as illustrated in decision box 15, each harmonious frequency of the lowest frequency-value is allocated with a tracker 16 and considered as a "candidate fundamental frequency". Non-harmonious frequencies are untracked.

According to some embodiments, each tracker is associated with one or more fields such as: (i) an intensity value related therewith (e.g. the SNR values of all harmonious frequencies of the tracker may be taken from the measured or filtered time-frequency representation of the respective time frame and averaged); (ii) a frequency value (e.g. the frequency values of all harmonious frequencies of the tracker may be taken from the measured or filtered time-frequency representation of the respective time frame and averaged); (iii) detection number ("N-detect") indicative of the number of times the respective tracker has been detected (the number of frames including the respective harmonious frequency); (iv) last update frame, indicative of the last time frame "1" where the respective tracker has been identified and updated. These fields may be updated with every iteration as indicated in box 19.

If 1>1, correlations between previously tracked harmonious frequencies and currently identified harmonious frequencies are checked 17. For example, the difference between the frequency value of each currently identified harmonious frequency of time frame "1" and past identified and tracked harmonious frequencies (referred to hereinafter also as "trackers") may be calculated and once the difference is below a predefined threshold the two are considered "correlated". The currently identified harmonious frequencies for which no correlated tracker was identified will be allocated with new trackers 18, while the ones who are correlated will be used to update fields of their respective correlated trackers 19. The SNR and frequency values will be averaged in respect to its previous value and the average value of the harmonies associated with the corresponding newly identified harmonious frequency, the N-detect will be increased by one and the update frames will be changed to the current value of "1".

According to some embodiments of the present invention as illustrated in box 21, in each iteration a single fundamental frequency "$f_{01}$" is estimated and determined, according to predefined one or more conditions. For example, the fundamental frequency will be the tracker with an SNR value that exceeds a predefined minimum threshold and that has the highest number of detections—mainly the tracker with the highest N-detect value, where its detections are determined as consecutive according to predefined rules. For example, another field "$f_0$ frames" indicative of the consecutiveness of the respective tracker detection is added and should be updated at each frame after a fundamental frequency f0 is determined (also included in operations of box 19). For example, the $f_0$ frames field may be an array, where the number of array-components is equivalent to the number of times the respective corresponding tracker was identified (estimated) as a fundamental frequency. For each such identified fundamental frequency the number in each component of the array is indicative of the respective time frame "1" in which the respective tracker was identified as a fundamental frequency. This can be used to track the consecutiveness level of the fundamental frequency for determining whether a tracker exceeding the SNR threshold that has the maximal N-detect number can be a valid fundamental frequency. The $f_0$ frames array will be empty for trackers that were not yet identified as a fundamental frequency.

To illustrate the process of selecting a fundamental frequency of each time frame indicated in box 21, let us use table 60 in FIG. 3. This table 60 shows the resulting updated fields of three trackers after three iterations (1=3). In this example three trackers were identified in the first iterations, where the one with the highest SNR was selected in the first iteration as the fundamental frequency, since they all had the same number of detections. In the second and third iterations only the third tracker was identified and therefore was selected in those iterations as the fundamental frequency although its respective average SNR value is lower than that of the other trackers. The $f_0$ frames array of the first tracker is empty, the $f_0$ frames of the second tracker includes a single component (is of length 1) indicative that this tracker was identified as a fundamental frequency in the first iteration, and the $f_0$ frames of third tracker is of length 2 indicative that this tracker was identified as a fundamental frequency in the two consecutive iterations 2 and 3.

According to some embodiments, the consecutively level may be determined by checking the gap between the current iteration "1" and the last updated iteration of the $f_0$ frames array—mainly subtracting the last iteration indicated in the last component of the $f_0$ frames array from "1".

According to some embodiments, with each iteration, the $f_0$ frames field is updated once the fundamental frequency of the respective time frame "1" is determined 22.

According to some embodiments of the present invention another process of updating the trackers may be carried out by the algorithm 20 after updating the trackers' fields. This process may include any one or more of the following exemplary steps: (1) checking for trackers which are harmonious to one another (e.g. by checking if the frequency value of each tracker is a multiplication of another tracker), in which case the two harmonious trackers may be merged into a single tracker, updating all its respective fields correspondently; (2) checking for "second degree correlations" between trackers, where the difference between the frequency values of each pair of trackers is checked to see if they can be considered correlated—in this operation the predefined threshold difference may be calculated according to the frequency values of all trackers; and/or (3) checking for outdated trackers according to the update tracker field indicative of the last time the respective tracker was updated (meaning detected).

The process of checking for secondary correlations, as mentioned above, may include calculating a threshold, in each iteration, in respect to the frequency values of all trackers. This means that if the trackers are all within a narrow frequency band (meaning that the difference between the highest frequency and the lowest one is small) the threshold will consequentially be low and vice versa—if the frequency band is wide—the threshold will be higher. For example, the threshold frequency value for identifying secondary correlations may be set to a predefined percentage rate of the frequency band (e.g. 30% of the band-width).

According to some embodiments of the present invention, outdated trackers are eliminated and untracked in future iterations. In this way only relevant frequencies are tracked saving time and complexity level of the process. To identify outdated trackers a predefined iterations threshold value Δ1 (e.g. 4 iterations) may be set where if the difference between the current iteration number or time frame "1" and the last update frame number exceeds the predefined threshold Δ1, the tracker is defined as "outdated".

According to some embodiments of the present invention, as illustrated in FIG. 2A, the identified fundamental frequency of the respective time frame "1" and/or information relating thereto is outputted and/or stored 23. The associated information may be all information of the fields of the respective tracker meaning the frequency and SNR values, the $f_0$ frames array, N-detection and update frame fields.

The frequency value and optional SNR value can be used for further analysis of the detected signal, e.g. for VAD purposes and/or for detection of speech segments in real time or near real time. The process illustrated in FIG. 2A in boxes 11-25 is recursive and is operated until no more time frames are received 24.

According to some embodiments of the present invention, as indicated in boxes 25-27 the algorithm checks a durability factor of the fundamental frequency of the respective time frame, for example, by having an N-detect value that exceeds a predefined threshold Δ2 (e.g. D2=30), the respective fundamental frequency is considered a "durable fundamental frequency" (DFF). Once identifying such DFF 25, all other trackers (that are not associated with the DFF) a rejected 26 and a different predefined reduced detection process is initiated 27. This reduced process is used to reduce time and complexity of the algorithm by assuming (especially when referring to voice detection utilization of the method) that if a fundamental frequency is continuous it is probably related to the pseudo-periodic signal that we wish to detect (e.g. pitch frequency characterizing a speaker and the respective word/syllable/phoneme) and therefore that the other trackers are associated with irrelevant sources (noise). If no DFF is identified, the process recursively repeats steps 13-25.

Figure 2B:
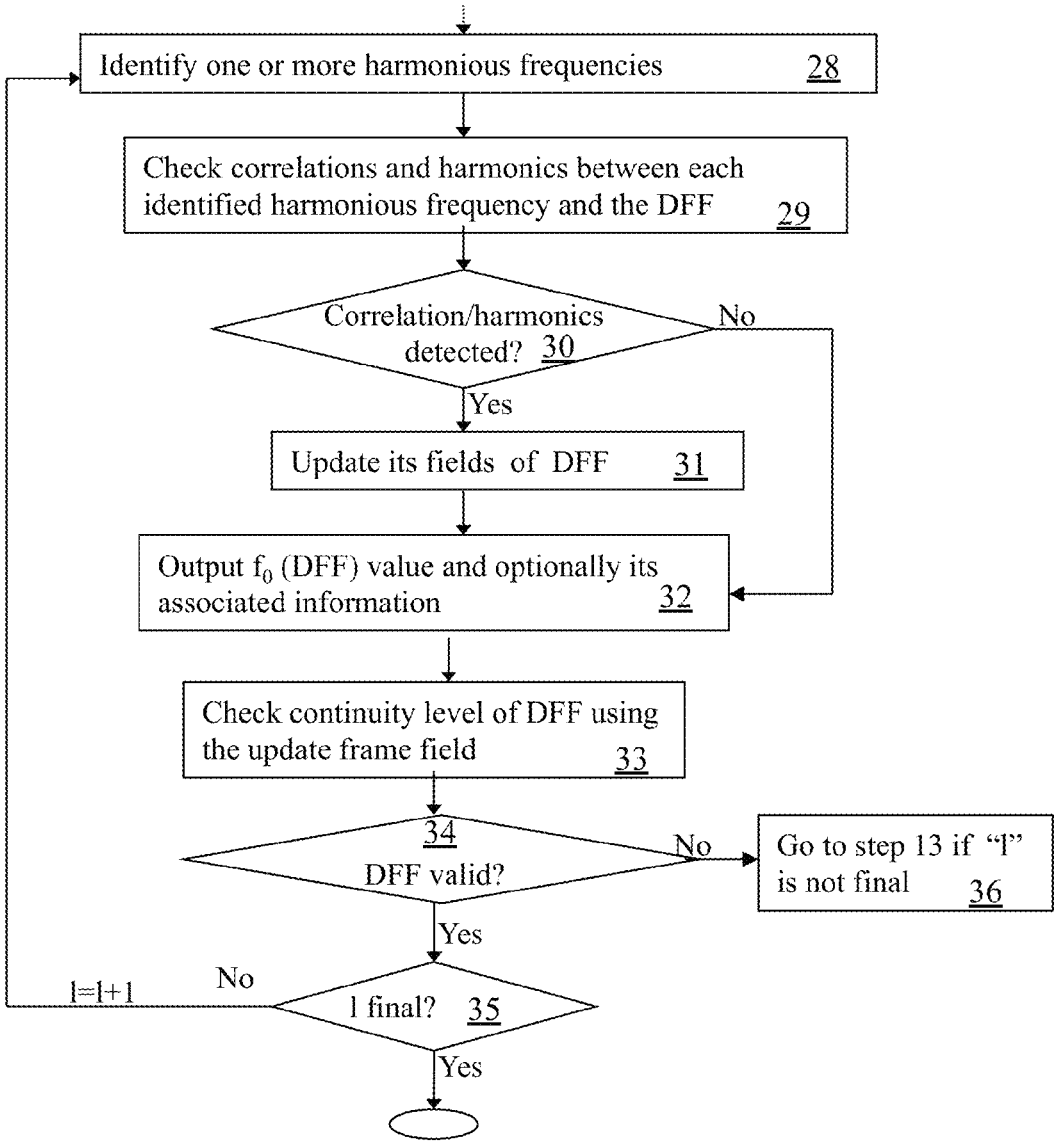
FIG. 2B is a flowchart, schematically illustrating a reduced tracking procedure, according to some embodiments of the present invention.

One embodiment of the reduced tracking process is schematically illustrated in FIG. 2B. According to this embodiment, the reduced tracking process includes identifying harmonious frequencies in the next iteration 28 and checking if any of them is a harmonious frequency of DFF or is correlated to the DFF 29. If at least one of the identified harmonious frequencies is either correlated or harmonious to the DFF (see decision indicated in box 30), then the fields of the DFF tracker are respectively updated 31. If no correlation/harmonious relation to DFF is identified (see decision indicated in box 30) the fields are not updated.

The last calculated average value of the fundamental frequency DFF is outputted 32, optionally along with information associated therewith, taken from its corresponding one or more fields. In the next step, a continuity level of the DFF is checked 33, mainly to see if the current DFF is still durable or another fundamental frequency should be estimated and tracked. The continuity level checking may include, for example, subtracting the current "1" value from the last updated value in the update frame of the DFF and determining that the DFF tracker is no longer "valid" if this difference exceeds a predefined threshold number (e.g. above 3 iterations during which the fields were not updated). If the DFF is valid (see decision box 34), and if "1" is not final (see decision box 35) the reduced process is recursively repeated. If the DFF is found to be invalid (see decision box 34) and "1" is not final, the algorithm reverts back to the unreduced process described in FIG. 2A (goes back to step 13 of FIG. 2A) 36.

Figure 4:
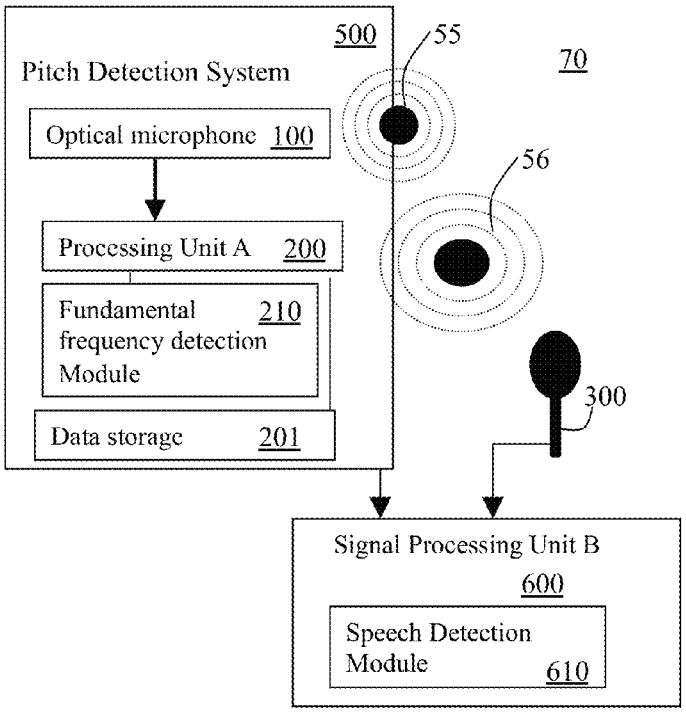
FIG. 4 schematically illustrates a system for estimation and tracking of fundamental frequencies ($f_0$) of pseudo-periodic signals in a non-stationary noisy environment, mainly for acoustic signals pitch detection, according to some embodiments of the present invention.

Reference is now made to FIG. 4, schematically illustrating a pitch detection system 500 for estimation and detection of fundamental frequencies of speech related acoustic pseudo-periodic signals located in a non-stationary noisy environment 70, according to some embodiments of the present invention. The system 500 includes a vibrometry-based optical microphone 100 enabling to sense vibrations of a speaker 55 by being located in proximity to the speaker's 55 vibrating surfaces (e.g. neck or face) and a processing module A 200 enabling to operate a designated software fundamental frequency detection module 210 that enables carrying out the processes described in FIGS. 1 and 2A-2B, for example for real time identification of the fundamental frequency of the speaker's speech related acoustic signal (pitch frequency).

Figure 6A:
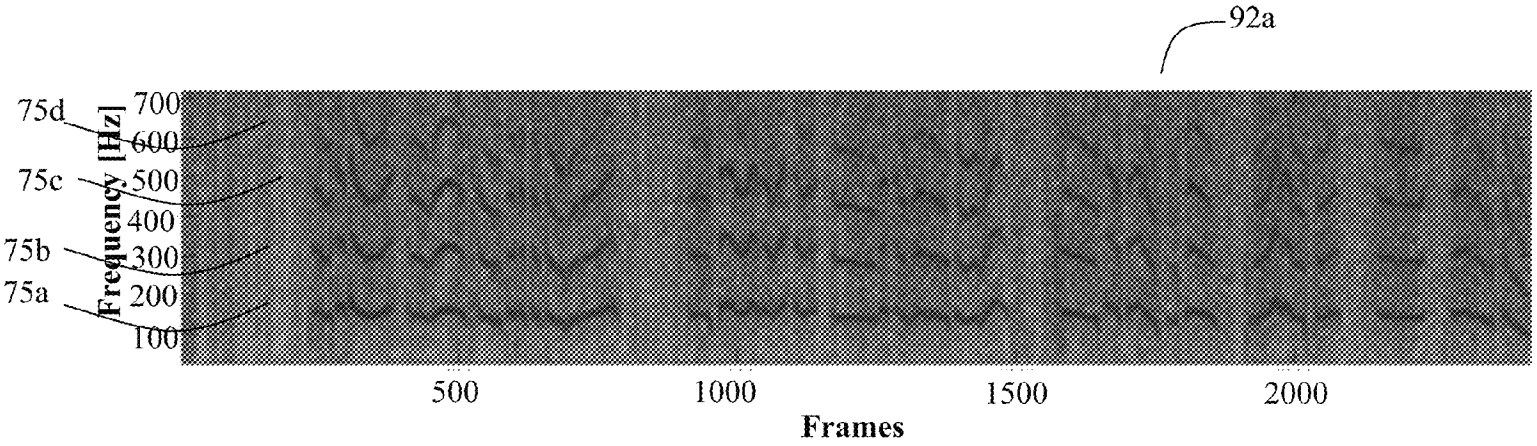
FIG. 6A shows a time-frequency distribution representing a spectrogram established by operating a short time Fourier Transform (STFT) over the optical signal of FIG. 4.
Figure 6B:
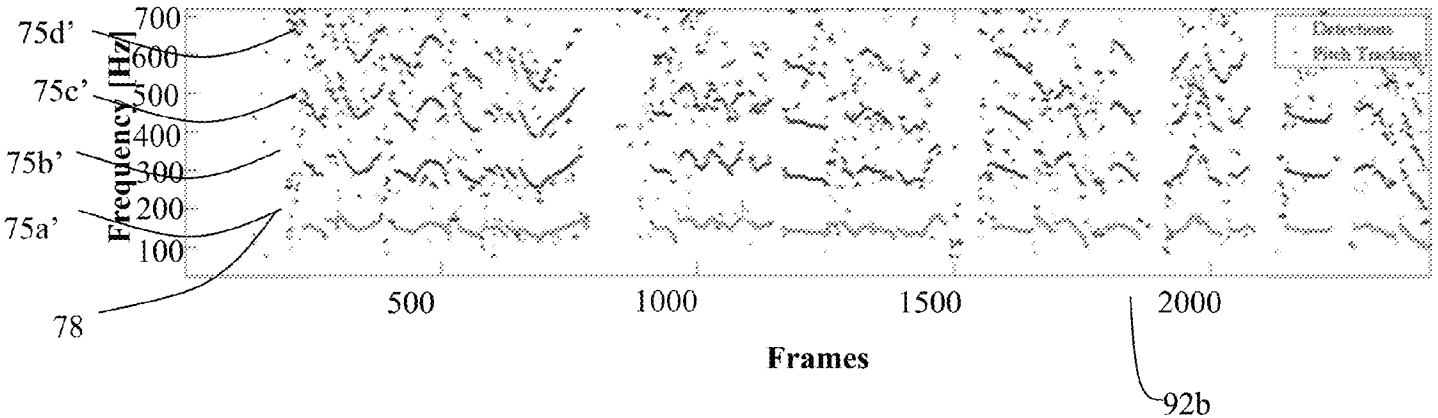
FIG. 6B shows a time-frequency distribution of selected peaks of the spectrogram of FIG. 6A including a pitch signal representation.
Figure 7:
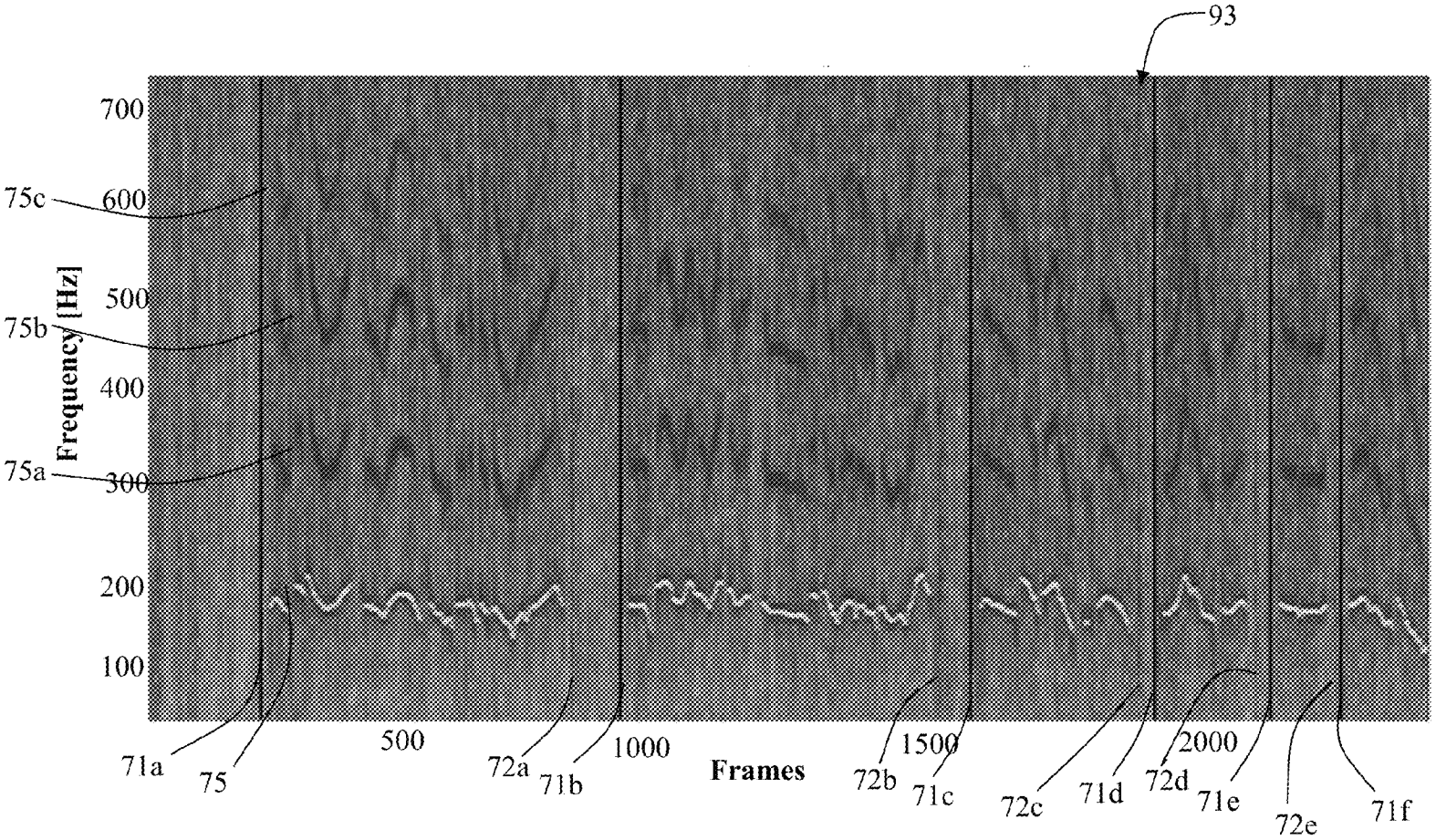
FIG. 7 shows a time-frequency distribution of the spectrogram of FIG. 6A including a pitch signal representation, including voice activity detection (VAD) for illustrating how the pitch detection is used for VAD related purposes.

The optical signal 91 outputted by the optical microphone 100, schematically illustrated in FIG. 5, showing output waveform over time, is transformed into its respective time-frequency representation (using STFT transformation), schematically shown in FIGS. 6A, 6B and 7. In these figures one can see the overall transformation although the process is carried out on a frame-by frame basis, where each time frame (e.g. each time interval or time line) is transformed and then analyzed/processed to output its respective fundamental frequency (e.g. pitch) separately.

According to some embodiments of the present invention, the environment 70 includes the speaker 55 as the sound source that is to be measured and at least one noisy source such as another speaker 56, background noises and other noises that are all picked by the optical microphone 100. Optical vibrometry-based microphones are substantially immune to background and other speakers' noises inter alia due to the fact that they are located near the vibrating surfaces of the relevant speaker and since they optically detect these vibrations. Optical microphones typically have low-pass filter, which means that it can be "blind" to the lower frequencies and therefore it may be recommended to use a combination of audio and optical microphones systems in the case of detection of speech related fundamental frequencies.

Audio microphones even when positioned close to the speaker's mouth are more likely to output acoustic signals that are much noisier than the optically acquired signals. In this example, using optical devices for sound detection, the optical signal alone can be used for the detection of pitches in real/near real time for further processing of the speech related pseudo-periodic signal and/or of the outputted pitches for reducing noise and improving analysis of acoustically acquired corresponding signals for many one or more purposes, as discussed above, such as VAD, speech detection or enhancement, speech segments' detection or simply for reducing noise of parallel acoustically acquired signals.

For example, another acoustic receiver such as an acoustic microphone 300 may be used where both the optical and acoustic microphones 100 and 300, respectively, measure the same acoustic signals in the same environment 70 simultaneously, where the optical signal is used for pitch detection in real time for real time improving analysis of the acoustic signal outputted by the acoustic microphone 300. A second signal processing unit 600 or the same first signal processing unit 200 may receive the output pitch frequency in real time from the fundamental frequency detection module 210 and the acoustic signal data from the acoustic microphone 300 and combine them to perform any one or more analysis techniques for any one or more purposes, using for example a designated speech detection module 610 for speech detection (e.g. VAD) taking the identified fundamental frequencies from the optically based pitch detection system 200 and the acquired respective acoustic signal.

For example, the pitch frequency outputted in real/near real time by the fundamental frequency detection module 210 may be used to identify the pitches of the measured optical signals and optionally allow storing them in predefined data storage 201. The identified pitches may be used to perform VAD over the acoustically acquired signal, where the characterizing pitches of the speaker's speech help identifying which parts of the signal over time is associated with the speaker's voice and which can be defined as "noise" indicating when the speaker speaks.

Another additional or alternative utilization of the pitch detection is to identify speech segments (e.g. identifying beginnings and endings of speech parts such as words, syllable, or phonemes) to enhance processes for identification of the actual content of detected speech related sound. This can be done, for example, by using the pitch detection for identifying endings and beginnings of speech parts whenever a dominant durable fundamental frequency (DFF) begins and ends as illustrated in FIG. 7. This allows using the optically acquired signal for speech segments identification while using the acoustically acquired signal for identification of the actual content of each segment.

Reference is now made to FIGS. 6A and 6B, which show a time-frequency distribution (TFD) 92*a* and a TDF 92*b* of the optical signal 91 of FIG. 5. The TDF represents measurements and processing carried out over time to illustrate the frame-by-frame process. TDF 92*a* shows substantially four frequency lines (signals) a first signal line 75*a* located in the area around f=150 Hz, a second signal 75*b* located in the area around f=300 Hz, a third signal 75*c* located in the area around f=450 Hz and a fourth signal 75*c* located in the area around f=600 Hz. After using one or more noise reduction filters such as the Global Noise Detection algorithm, a noise-reduced spectrogram 92*b* of the original TDF 92*a* is created showing corresponding clean first, second third and fourth signals 75*a*', 75*b*', 75*c*' and 75*d*' correspondently.

After processing these signals using the above described tracking of fundamental frequencies method, as illustrated in FIG. 6B, the resulting fundamental frequency (tracked by the algorithm) is indicated and illustrated by line 78 showing that the speech related fundamental frequency was tracked and was in the area of 150 Hz slightly changing over time due to changes in intonation of the speaker and/or changes of facial vibrations in relation to each word/phoneme pronounce, for instant, and the like. It is clear form TFDs 92*a* and 92*b* that there are blank spaces along the lines of 75*a*-75*d*, 75*a*'-75*d*' and 78. These blank spaces are indicative of time frames and time-intervals in which no speech is detected. Other indications for ending and/or beginning of a speech segment such as a word, a syllable or a phoneme can be deduced from the pattern of line 78. For example, an ending of a speech segment can be identified by a slight raise and/or drop of the pitch value of the pitch frequency. The pitch detection process (when using our method for voice and speech detection using acoustic signals) may improve detection of the exact locations over the time axis in which the speech segment begins and/or ends and therefore improve speech analysis for identification of the content of these speech segments.

FIG. 7 shows a TFD 93, which is the TDF 92*a* having the outputted tracked fundamental frequency line 75 indicated thereover. In this illustration the beginning and ending of speech parts have been marked showing a first speech segment identified between mark lines 71*a* and 72*a*, where 72*a* indicates the beginning of the speech segment and mark line 72*a* indicates the ending thereof. In the same way mark lines 71*b* and 72*b* show the borders of a second speech segment, mark lines 71*c* and 72*c* show the borders of a third speech segment, mark lines 71*d* and 72*d* show the borders of a fourth speech segment, mark lines 71*e* and 72*e* show the borders of a fifth speech segment, and mark up line 71*f* shows a beginning of another fifth speech segment.

According to some embodiments of the invention, the application enabling to detect and track fundamental frequencies of pseudo-periodic signals as described above can be operated by any number of processing units through one or more computerized systems.

The application can be adapted to receive a frame-by-frame input detected signals and/or to receive an entire stored detection of signals over time and recursively process the detection data on a frame-by-frame basis.

According to some embodiments of the present invention, the identification of fundamental frequencies method and/or system can be used for enhancing LSA or OMLSA speech detection applications/operators by providing the fundamental frequency of the respective frames. The respective fundamental frequency of each time-frame, estimated by the application (e.g. by the fundamental frequency detection module 210), may be fed as an input parameter of the LSA/OMLSA operator, where the operator may require a few modifications for allowing improving its speech detection abilities by using the input from the fundamental frequency detection module 210.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

What is claimed is:

1. A computer implemented method of tracking fundamental frequencies of pseudo-periodic signals in the presence of noise, said method comprising:

receiving a time-frequency representation of signals measured in a predefined environment;

estimating and tracking a fundamental frequency of a respective pseudo-periodic signal at each time frame of said time-frequency representation by tracking detections of harmonious frequencies in said time-frequency representation over time; and outputting said respective estimated fundamental frequency associated with said pseudo-periodic signal of each said respective time frame;

wherein a respective said fundamental frequency is tracked, recorded in a memory unit, and identified in each time frame of said time-frequency representation;

wherein said estimation and tracking of the fundamental frequency of each respective time frame comprises:

identifying harmonious frequencies in each time frame of said time-frequency representation;

checking correlations between each identified harmonious frequency and harmonious frequencies identified in preceding time frames;

allocating a new tracker to each respective identified uncorrelated harmonious frequency;

updating information relating to each tracker including number of identified correlations associated with each said tracker; and determining said fundamental frequency of the respective time frame by selecting one of said trackers, according to predefined rules associated with accumulated information of said trackers, including the number of correlations associated with each said tracker.

2. The method according to claim 1, wherein said updating of information comprises updating predefined fields of said trackers, said fields include at least one of:

signal power field, indicative of the average signal intensity of each tracker;

detections field, indicative of the number of times the associated tracker has been detected, which is indicative of the correlations number of said respective tracker;

frequency value field, indicative of the average value of the frequency associated with each said respective tracker;

frames field, each is an array field associated with each respective said tracker that has been identified as a fundamental frequency, wherein each component in said array is indicative of the time frame number in which said fundamental frequency tracker has been tracked; and/or last update field, indicative of the last time frame number of the respective tracker, in which the respective tracker has been tracked.

3. The method according to claim 2, wherein each detected fundamental frequency of the respective time frame is determined by selecting a tracker that has an optimal combination of signal power, using said signal power field, and number of detections, using said detections field, in respect to a duration level of said respective tracker calculated according to said frames field of each respective tracker, said duration level is indicative of the number of successive detections of said respective tracker.

4. The method according to claim 3 further comprising identifying a durable fundamental frequency (DFF) out of the trackers, using said duration level, and operating a reduced estimation and tracking procedure upon identification of said DFF, for tracking only the identified DFF.

5. The method of claim 4, wherein said identification of a respective DFF is carried out by checking whether the number of detections of each said tracker, using its respective detections field, exceeds a predefined threshold number, indicating said continuous fundamental frequency tracker and rejecting all other trackers, wherein said reduced tracking procedure comprises identifying new harmonious frequencies in the respective current time-frame and checking their correlation with said continuous fundamental frequency, wherein correlated detections are used for updating the fields associated with said respective DFF, and wherein said reduced tracking procedure is terminated upon identifying discontinuity of said continuous fundamental frequency, using said associated fields, said termination allows reverting to previous procedure.

6. The method according to claim 2 further comprising updating trackers before determining a respective said fundamental frequency of the respective time frame, wherein said updating of the trackers includes at least one of:

checking for trackers that are harmonious to one another, according to predefined rules, using said frequency value field, and merging such identified harmonious trackers;

checking for trackers that have secondary correlations with one another, according to predefined rules, using said frequency value field, and merging such identified correlated trackers; and/or identifying outdated trackers, using last update field, and discarding all trackers that are identified as outdated.

7. The method according to claim 1 further comprising:

receiving a detected signal input in real time or near real time; and operating a signal transformation over said received signal input, in real time, said transformation enables transforming said respective signal representation into said respective time-frequency representation.

8. The method according to claim 7, wherein said transformation includes a short-time Fourier transform (STFT) transformation.

9. The method according to claim 1 further comprising operating at least one of: Noise Spectrum Evaluation; peak detection, in real time or in near real time over said time-frequency representation.

10. The method according to claim 9, wherein said noise spectrum evaluation is based on minima controlled recursive averaging (MCRA) or improved MCRA.

11. The method according to claim 1, wherein said pseudo-periodic signal is an acoustic signal indicative of human speech in said noisy environment, wherein said acoustic signal is acquired by using at least one signal measurement system.

12. The method according to claim 11 further comprising using said fundamental frequency identification and associated information thereof with each time frame for enhancing speech detection of said acoustic signal, by indicating the pitch of the detected speech in each respective time frame, wherein said pitch is proportional to the fundamental frequency of the respective time frame.

13. The method of claim 12, wherein said signal measurement system comprises at least one optical or acoustic device enabling to optically or acoustically measure and represent said acoustic signals in said noisy environment.

14. The method of claim 13, wherein said signal measurement system includes at least one optical microphone, which is based on optical vibrometry detection of sound.

15. A system for tracking fundamental frequencies of pseudo-periodic signals in the presence of noise, said system comprising:

a signal measurement system for measuring pseudo-periodic signals in a predefined environment;

at least one processing unit, which receives measured pseudo-periodic signals in real time or near real time from said signal measurement system, processes said signal for obtaining a time-frequency representation thereof in real time or near real time and recursively estimates, tracks a respective fundamental frequency of each respective pseudo-periodic signal at each time frame of said time-frequency representation by tracking detections of harmonious frequencies in said time-frequency representation over time, and outputs said respective estimated fundamental frequency associated with said pseudo-periodic signal of said respective time frame; and wherein said estimation and tracking of the fundamental frequency of each respective time frame is carried out by:

identifying harmonious frequencies in each time frame of said time-frequency representation;

checking correlations between each identified harmonious frequency and harmonious frequencies identified in preceding time frames;

allocating a new tracker to each respective identified uncorrelated harmonious frequency;

updating information relating to each tracker including number of identified correlations associated with each said tracker; and determining said fundamental frequency of the respective time frame by selecting a tracker according to accumulated information including the number of correlations associated therewith.

16. The system according to claim 15, wherein said signal measurement system comprises an optical measurement system for optically detecting said pseudo-periodic signals in said environment.

17. The system according to claim 15, wherein said optical measurement system includes an optical microphone enabling vibrometry-based detection of acoustic signals including speech related signals, said optical microphone is located in proximity to vibrating surfaces of a respective speaker.

18. The system according to claim 17, said system is operatively associated with at least one audio system enabling to acoustically measure said acoustic signals in said environment, wherein fundamental frequencies estimated by using respective optically measured signals are used to improve corresponding detection of acoustic signals carried and outputted by said acoustic system, for voice activity detection (VAD).

19. The system according to claim 15 further comprising at least one fundamental frequency detection module for detecting and tracking said fundamental frequencies and outputting thereof, said fundamental frequency detection module is a software application operated by said at least one processing unit.

* * * * *